US009004156B2

(12) United States Patent
Morrison

(10) Patent No.: US 9,004,156 B2
(45) Date of Patent: Apr. 14, 2015

(54) FLOW ACTIVATED SENSOR ASSEMBLY

(75) Inventor: Angus Morrison, Aberdeen (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 443 days.

(21) Appl. No.: 13/311,713

(22) Filed: Dec. 6, 2011

(65) Prior Publication Data

US 2012/0241167 A1 Sep. 27, 2012

Related U.S. Application Data

(60) Provisional application No. 61/466,346, filed on Mar. 22, 2011.

(51) Int. Cl.

| | |
|---|---|
| ***E21B 47/00*** | (2012.01) |
| ***E21B 41/00*** | (2006.01) |
| ***E21B 43/1185*** | (2006.01) |
| ***E21B 47/18*** | (2012.01) |

(52) U.S. Cl.

CPC ..... *E21B 41/00* (2013.01); *E21B 43/11852* (2013.01); *E21B 47/18* (2013.01)

(58) Field of Classification Search

USPC ..... 166/66; 73/152.21, 152.22, 152.29; 340/853.3, 854.3, 856.4; 367/83

See application file for complete search history.

(56) References Cited

U.S. PATENT DOCUMENTS

| | | | | |
|---|---|---|---|---|
| 4,886,126 | A | 12/1989 | Yates | |
| 4,994,188 | A * | 2/1991 | Prince | 210/636 |
| 5,226,494 | A | 7/1993 | Rubbo | |
| 5,995,449 | A * | 11/1999 | Green et al. | 367/83 |
| 2002/0109080 | A1 | 8/2002 | Tubel | |
| 2003/0218939 | A1 | 11/2003 | Casarsa | |
| 2006/0131014 | A1 * | 6/2006 | Huang et al. | 166/250.07 |
| 2006/0157239 | A1 * | 7/2006 | Ramos et al. | 166/254.2 |

* cited by examiner

*Primary Examiner* — Cathleen Hutchins

(57) ABSTRACT

A sensor assembly for detection of fluid flow signaling over a tubular conveyance. The assembly may be employed for activation of a variety of different downhole actuators such as firing heads for perforating guns or hydrostatic set modules for packer deployment. The assembly is configured with a flow translation device which is disposed in a manner exposed to fluid flow directed through an oilfield tubular coupled to the assembly. Thus, a detector coupled to the translation device may obtain mechanical data from the device which is reliably indicative of the flow, irrespective of the physical nature of the flow itself. As such, enhanced reliability for subsequent actuator firing based on the flow signaling may be achieved.

17 Claims, 6 Drawing Sheets

FLOW ACTIVATED SENSOR ASSEMBLY

PRIORITY CLAIM/CROSS REFERENCE TO RELATED APPLICATION(S)

This Patent Document claims priority under 35 U.S.C. §119 to U.S. Provisional App. Ser. No. 61/466,346, filed on Mar. 22, 2011, and entitled, "Flow Activated Rotation Sensed Enabler Attachment for Electronic Firing Head", incorporated herein by reference in its entirety.

BACKGROUND OF THE RELATED ART

Exploring, drilling and completing hydrocarbon and other wells are generally complicated, time consuming and ultimately very expensive endeavors. As a result, over the years well architecture has become more sophisticated where appropriate in order to help enhance access to underground hydrocarbon reserves. For example, as opposed to wells of limited depth, it is not uncommon to find hydrocarbon wells exceeding 30,000 feet in depth. Furthermore, as opposed to remaining entirely vertical, today's hydrocarbon wells often include deviated or horizontal sections aimed at targeting particular underground reserves.

While such well depths and architecture may increase the likelihood of accessing underground hydrocarbons, other challenges are presented in terms of well management and the maximization of hydrocarbon recovery from such wells. For example, during the life of a well, a variety of well access applications may be performed within the well with a host of different tools or measurement devices. However, providing downhole access to wells of such challenging architecture may require more than simply dropping a wireline cable into the well with the applicable tool located at the end thereof. Thus, coiled tubing is frequently employed to provide access to wells of such challenging architecture.

Coiled tubing operations are particularly adept at providing access to highly deviated or tortuous wells where gravity alone fails to provide access to all regions of the wells. During a coiled tubing operation, a spool of pipe (i.e., a coiled tubing) with a downhole tool at the end thereof is slowly straightened and forcibly pushed into the well. This may be achieved by running coiled tubing from the spool and through a gooseneck guide arm and injector which are positioned over the well at the oilfield. In this manner, forces necessary to drive the coiled tubing through the deviated well may be employed, thereby delivering the tool to a desired downhole location.

Applications which may be carried out via coiled tubing include perforating, isolating and others which may involve the use of a firing head. For example, in the specific case of perforating, a firing head may be employed to set off a perforating gun in order to form perforations into a formation surrounding a main bore of the well. Given the generally cable-free nature of the coiled tubing and the potential well depths involved, it may be advantageous to actuate such a firing head in a remote fashion. Generally, this is achieved by way of ball-drop technique, whereby a ball or other suitable projectile is introduced into the coiled tubing at the oilfield surface and allowed to migrate downhole to a ball seat at the firing head which ultimately triggers firing thereof.

The noted ball-drop technique may be a bit lacking in terms of speed and precision. That is to say, the time elapse between the introduction of the ball to the coiled tubing at surface and the actual triggering may be quite significant and variable. So for example, depending on the depths and flow rates involved, this time elapse may average 30 minutes, plus or minus several more minutes. Therefore, where a quicker or more accurate triggering technique is desired, the ball-drop technique may be replaced with a flow signature technique. That is, given an available fluid flow through the coiled tubing, the firing head may be equipped with a flow detector receptive to a flow signature generated at surface. For example, pump rates of between about ½ barrel per minute (BPM) and about 2 BPM may be dynamically employed to generate a signal recognizable by the firing head to achieve activation thereof. Further, with a column of fluid already flowing within the coiled tubing, no significant time elapse between signal generation at surface and downhole firing head triggering may result. Thus, a more timely and accurate activation may be achieved.

While potentially more timely and accurate, a flow directed activation of a firing head is primarily responsive to conventional liquid fluid flow. However, in many circumstances, the introduction of liquids into the well via the coiled tubing may present significant drawbacks. For example, in many environments coiled tubing fluid in the form of seawater is employed until such time as the well begins producing. Thereafter, the coiled tubing flow may consist of a more inert nitrogen or other gas so as to avoid killing or otherwise hampering well production.

Unfortunately however, employing a flow signature for firing head detection is generally unreliable where a conventional flow detector and gas flow are utilized. Therefore, a degree of time savings and accuracy are generally sacrificed where triggering of a firing head is sought in environments which are non-conducive to the introduction of fluid flow.

SUMMARY

A flow activated sensor assembly is described herein. The assembly includes an oilfield tubular with a channel for fluid-flow running therethrough. A flow translation device is disposed within the channel for responsive movement upon exposure to the fluid flow. Thus, a detector which is coupled to the device for communication therewith, may be configured to trigger firing of a firing head coupled to the assembly based on the noted communication.

DETAILED DESCRIPTION

Embodiments are described with reference to certain oilfield tubular operations employing an assembly for triggering firing head based on flow driven signaling. In particular, a coiled tubing assembly employing a flow activated sensor assembly for directing a perforating gun is described in detail. However, a variety of other applications may make use of embodiments of a flow activated sensor assembly as detailed herein. For example, plug or packer setting, such as by way of a hydrostatic set module or other actuator may take advantage of such a sensor assembly. Further, operations may be run on drill pipe or production tubular, in addition to coiled tubing. Regardless, the assembly includes a detector for triggering actuation that is coupled to a flow translation device in the tubular channel. As such, gas flow or an imbalance in fluid hydrostatics need not be an impediment to flow based signaling of actuation.

Figure 1:
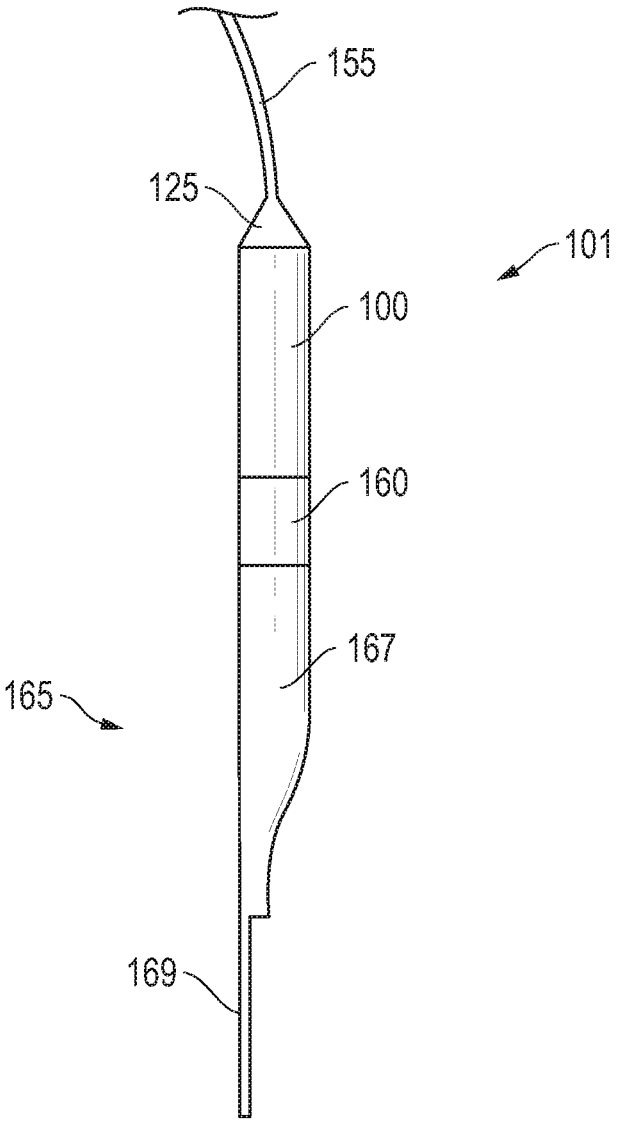
FIG. 1 is a front view of a downhole firing system incorporating an embodiment of a flow activated sensor assembly.

Referring now to FIG. 1, a front view of a downhole firing system 101 is shown which incorporates an embodiment of a flow activated sensor assembly 100 as detailed below. In the embodiment shown, the system includes a perforating gun 165 with conventional firing head 167 and charge extension 169 for forming perforations 293 in a formation 290 as also detailed below (see FIG. 2).

Figure 2:
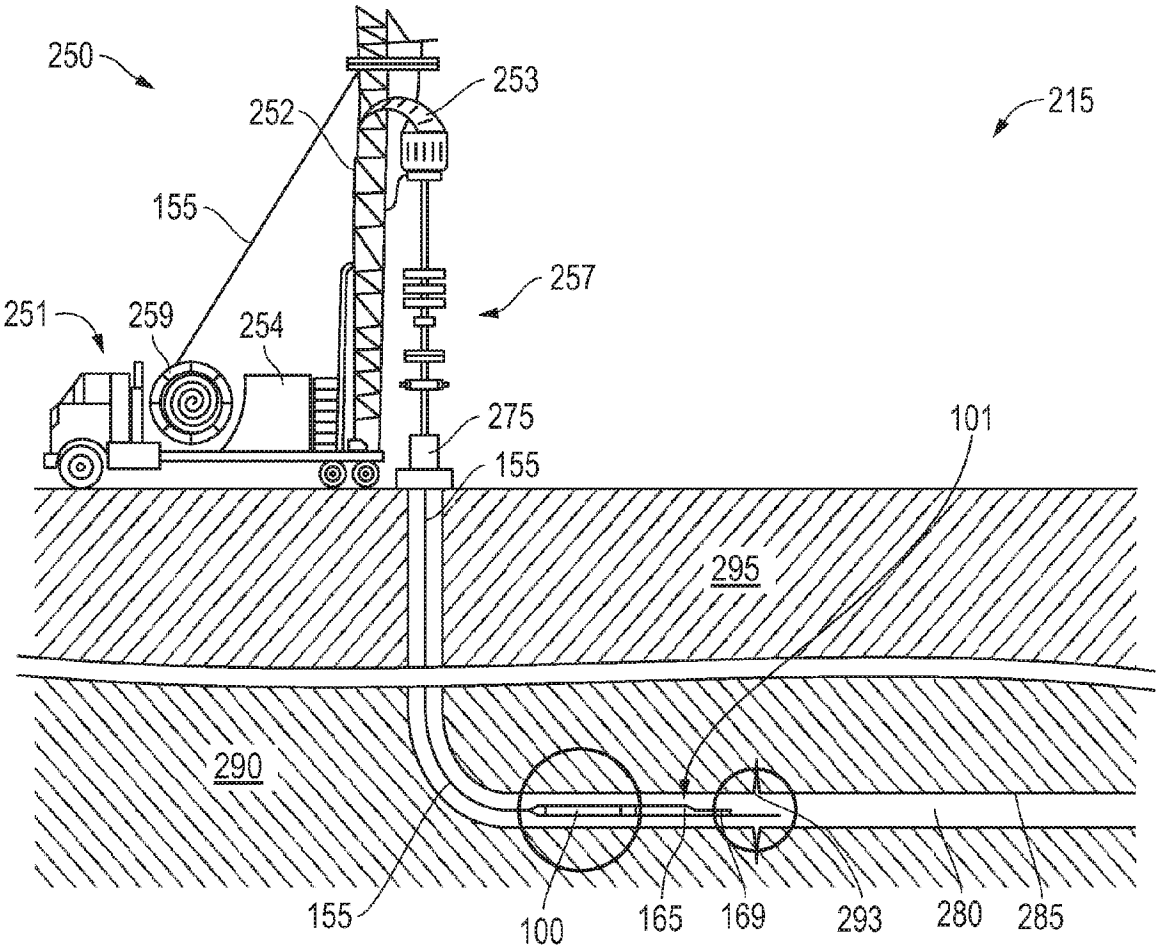
FIG. 2 is an overview of an oilfield with a well accommodating the system and assembly of FIG. 1 therein.
Figure 3A:
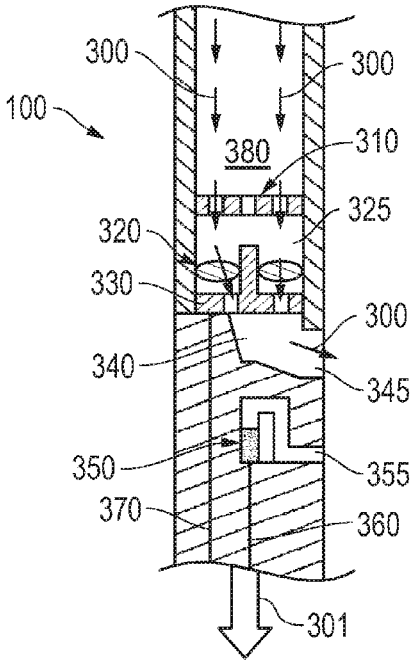
FIG. 3A is an enlarged schematic representation of an embodiment of the sensor assembly.

Continuing with reference to FIG. 1, with added reference to FIG. 3A, the flow activated sensor assembly 100 is configured to detect fluid flow 300 in a manner to allow triggering of the gun 165. More specifically, the assembly 100 is configured to decipher a signature pattern of fluid flow 300 directed from surface equipment 250 and through coiled tubing 155 coupled to the assembly 100 (see FIG. 2). Perhaps most notably, this fluid flow 300 need not be of a reliably consistent liquid variety. That is to say, the assembly 100 is outfitted with a flow translation device 320. As detailed below, this device 320 is capable of rendering a reliable readable output even in circumstances where the flow 300 is of a gas or more intermittent variety in terms of physical state.

The system 101 also includes a coupling head 125 for coupling the assembly 100 to the coiled tubing 155 as well as conventional power and electronic housing 160. The housing 160 in particular, need not be a discrete package as depicted. Regardless, sufficient downhole power may be provided for sake of detection and mechanical signal analysis, for example by way of a conventional lithium ion battery. As such, detections by a detector of the assembly 100 may ultimately be decoded into triggering instruction as detailed below.

Referring now to FIG. 2, an overview of an oilfield 215 is shown with a well 280 accommodating the system 101 and assembly 100 of FIG. 1 therein. The well 180 is of a horizontal variety. Thus, advancement of the system 101 is suitably achieved through the aid of conventional coiled tubing 155. Of course, alternate tubulars such as drill pipe and other conveyances may take advantages of assemblies 100 as detailed herein. As shown in FIG. 2, coiled tubing surface equipment 250 is disposed adjacent a well head 275 at the oilfield 215. The equipment 250 includes a standard coiled tubing truck 251 outfitted with a mobile rig 252. The rig 252 in turn supports a conventional gooseneck injector 253 configured to obtain and forcibly direct the coiled tubing 155 through valve and pressure control equipment, generally referred to as a 'Christmas tree' 257.

Continuing with reference to FIG. 2, with added reference to FIG. 3A, the coiled tubing truck 251 also accommodates a coiled tubing supply in the form of a reel 259 along with a control unit 254 to direct operations. So, for example, the control unit 254 may be configured to direct fluid flow 300 through the coiled tubing 155 and toward the downhole system 101, including the sensor assembly 100. This may include directing a particular signature of fluid flow 300 to the assembly 100 for triggering of the firing head 167 of the gun 165. As such, perforations 293 may be formed in a wall 285 of the well 280.

Continuing with reference to FIGS. 2 and 3A, directing a signature of fluid flow 300 as noted may include directing fluid in the form of an inert gas or perhaps even intermittent or imbalanced liquid flow without concern over signal reception at the assembly 100. Of course, depending on the nature of downhole conditions, the fluid flow 300 may also be in the form of a liquid. So, for example, in a non-producing well 280, the fluid flow 300 may be water such as seawater or other readily available source. On the other hand, where the well 280 is producing, an inert nitrogen gas may serve as the fluid flow 300 so as to leave production largely undisturbed. Regardless, the communicated signature of the fluid flow 300 directed by the control unit 245 may ultimately trigger perforating without concern over the integrity of the communication.

Referring more specifically now to FIG. 3A, an enlarged schematic representation of an embodiment of the sensor assembly 100 and internal components is shown. The noted fluid flow 300 is pumped through the assembly 100 and may take the form of a particular signature, such as that depicted in FIG. 3B, so as to ultimately trigger a perforation application as alluded to above.

The assembly 100 of FIG. 3A includes a central channel 380 through which the fluid flow 300 is driven. In the embodiment of FIG. 3A, the flow 300 passes a flow translation device 320 of sufficient sensitivity so as to display mechanical responsiveness regardless of the particular physical nature of the flow 300. So, for example, the device 320 may be of a propeller or spinner configuration as depicted in FIG. 3A, such that rotation thereof is achieved, whether the flow 300 takes the form of liquid seawater, nitrogen gas, or other suitable directed fluid.

The assembly 100 is outfitted with a conventional detector 330. However, in the embodiment shown, the detector 330 is wired to the translation device 320 for data communication therewith. Therefore, mechanical responsiveness of the device 320 serves to supply the detector 330 with signal information which may be relayed by the detector 330 in the form of a command signal 301. Note the signal relay wiring 370 from the detector 330 to downhole components (such as the firing head 167 of FIG. 5).

With added reference to FIG. 2, additional features of the flow activated sensor assembly 100 may include an exit chamber 340 and port 345 to accommodate continuous flow 300 out of the assembly 100. Further, a conventional filter 310 in combination with the disposal of the device 320 within a chamber 325 may be provided. Thus, the mechanical spinning nature of the particular embodiment of the translation device 320 depicted may be somewhat protected. Further, in one embodiment, the inner diameter of the chamber 325 may be relatively smaller than that of the surrounding channel 380 so as to enhance effect of flow 300 on the translation device 320.

Continuing with reference to FIG. 3A, the assembly 100 may also be outfitted with a conventional transducer 350 having exposure to the well 280 via outlet 355 (see FIG. 2). Thus, should the mechanical nature of the device 320 ultimately lead to any significant wear or reliability issues, thereby compromising data acquisition and communication, a backup mode of detection may be available. For example, fluid flow 300 may be directed from surface, through the annulus of the well 380 adjacent the assembly 100. Thus, the transducer 350 may serve as a backup detector for where liquid fluid flow 300 signaling external the channel 380 is appropriate. Therefore, with additional relay wiring 360 in place, emerging from the transducer 350 a command signal 301 may still be sent to the firing head 167 (see FIG. 5).

Figure 3B:
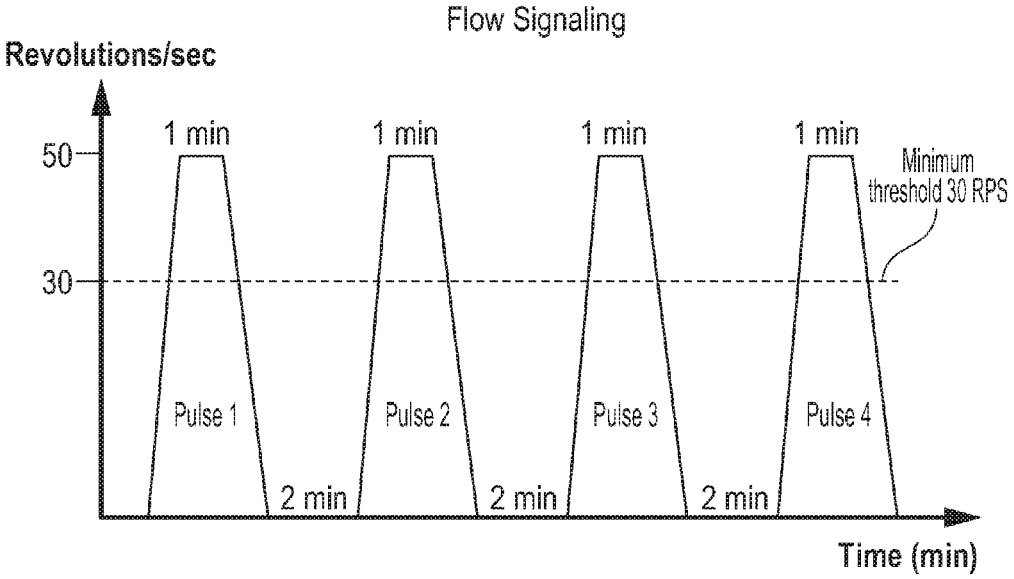
FIG. 3B is a graph depicting flow signaling employed in conjunction with the embodiment of sensor assembly depicted in FIG. 3A.

With added reference to FIG. 3B, a graph is shown depicting how a signal pattern of the fluid flow 300 as detected by the detector 330 might be represented. That is, signature pulsing of fluid flow 300 may be intercepted by the translation device 320, the mechanical effect, or resistance, of which being detected by the detector 330. Thus, the detection may be readably normalized, for example, as the speed of the spinner of the detector 330 is discernably altered by a signature of the flow 300, irrespective of its physical nature (e.g. gas, liquid or mixture).

Figure 5:
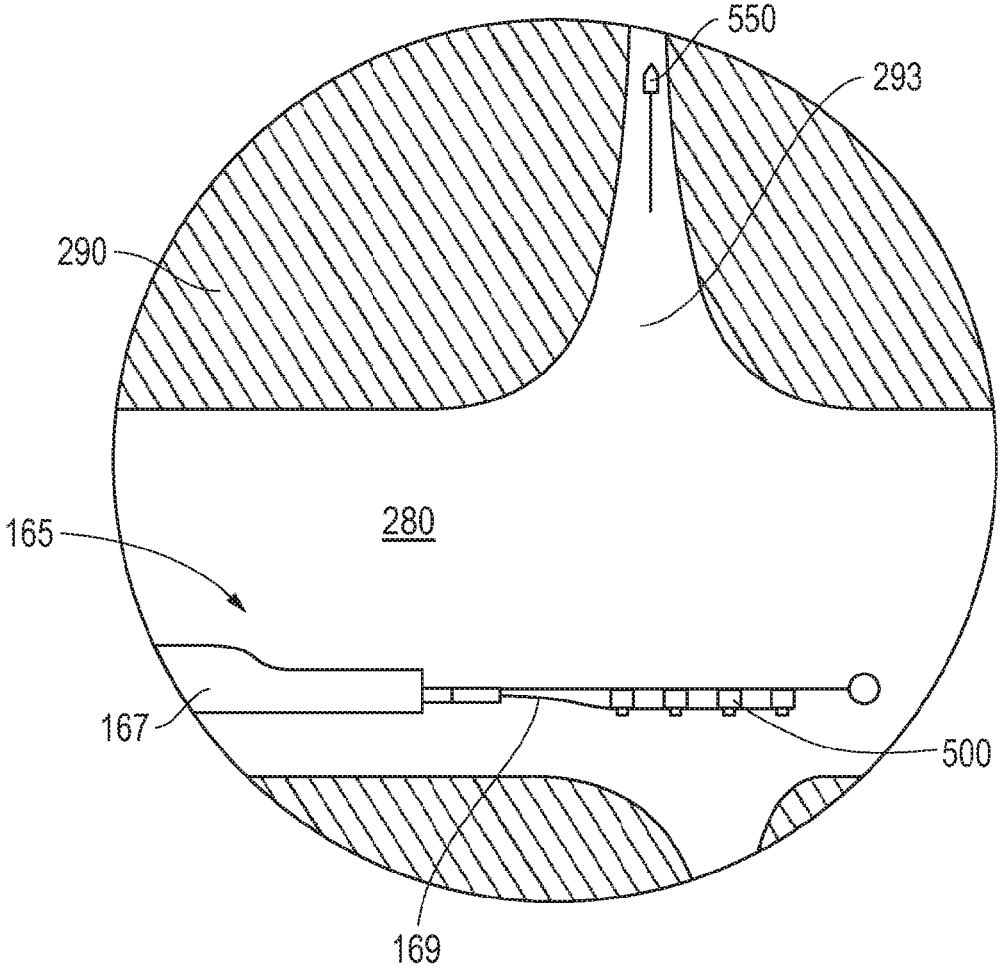
FIG. 5 is an enlarged view of a firing actuation triggered by an embodiment of the flow activated sensor assembly.

In the embodiment shown in FIG. 3B, the flow 300 of FIG. 3A is revealed to be of a pattern to alter spinner revolutions per second (RPS) of the device 320. So, for example, a pattern of pulses having the appropriate magnitude or rate, duration, and other signature characteristics may be employed to signal firing of the perforation gun 165 of FIG. 1. In this manner, such a signature pattern may be detected by the detector 330, relayed via signal 301, and decoded at a processor of the electronics housing 160 so as to initiate perforating as depicted in FIG. 5.

A particular signature pattern is revealed in the embodiment of FIG. 3B. For example, a series of pulses exceeding about 30 RPS for a duration of about one minute are employed to initiate firing in a perforating application. Indeed, a discrete period of about two minutes is also shown between the pulses. Of course, however, a variety of different signature patterns may be employed utilizing a host of different pulse durations, delays, thresholds and other characteristics.

Figure 4A:
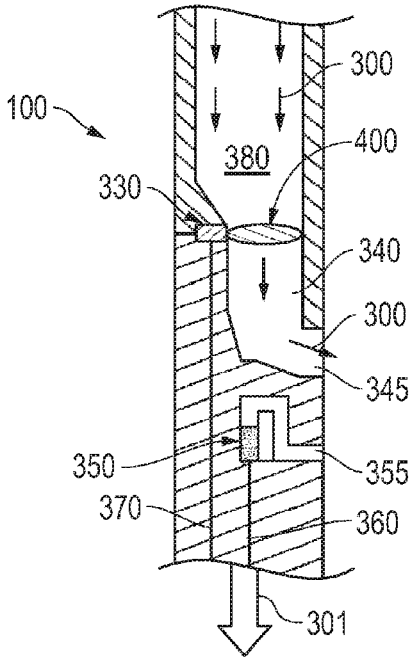
FIG. 4A is an enlarged schematic representation of an alternate embodiment of the sensor assembly.

Referring now to FIG. 4A, an enlarged schematic representation of an alternate embodiment of the sensor assembly 100 is depicted. In this embodiment, the spinner configuration of the translation device 320 is replaced with a check valve or flapper valve 400 version of the device. Thus, like a binary on-off switch, the fluid flow 300 through the channel 380 is either sufficient to open the valve 400 or it isn't. So, for example, the valve 400 may be equipped with an orifice, or otherwise provide suitable passage for a certain degree of flow 300 therethrough without opening thereof. However, once a predetermined flow rate is reached, the flapper valve 400 may be forcibly opened in a manner detectable by the detector 330.

Continuing with reference to FIG. 4A, the flapper valve 400 is shown in a closed position. However, fluid flow 300 through the channel 380 is able to pass the valve 400 and chamber 340, empting from the assembly 100 at the port 345. So, for example, in the embodiment of FIG. 4A, a flow rate of less than about 1 barrel per minute (BPM) may be depicted. However, as noted below, an increase in the flow rate to a predetermined threshold above 1BPM may be pulsatingly employed to open and close the flapper valve 400 in a decipherable signature pattern.

Figure 4B:
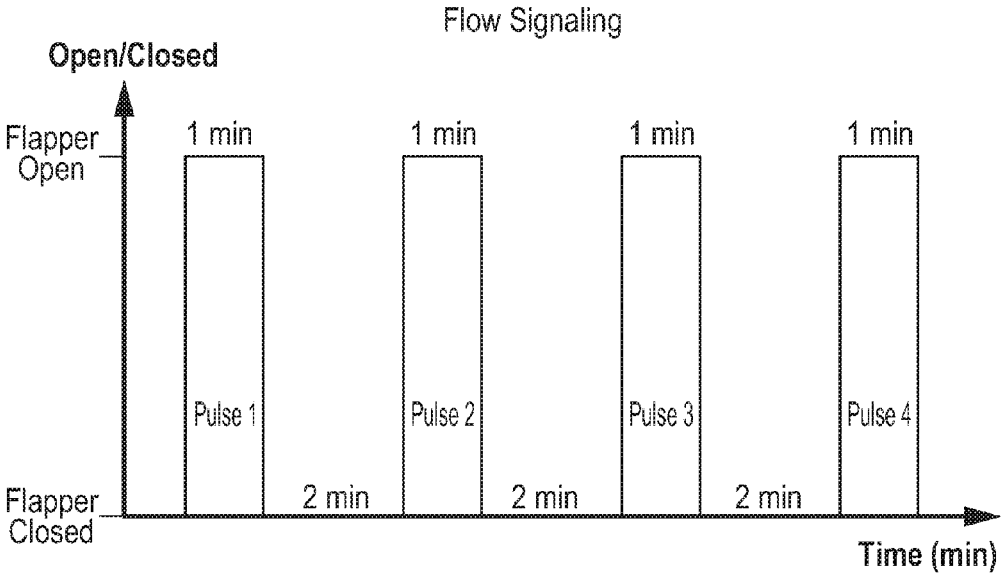
FIG. 4B is a is a graph depicting flow signaling employed in conjunction with the embodiment of sensor assembly depicted in FIG. 4A.

Referring to FIG. 4B, the noted flow signaling via the sensor assembly 100 embodiment of FIG. 4A is shown in the form of a graph. The graph again depicts how a signal pattern of the fluid flow 300 as detected by the detector 330 might be represented. However, unlike the spinner embodiment of the translation device 320 of FIG. 3A, the signature pattern detected by the flapper valve 400 configuration provides a more discrete 'on' vs. 'off' readout. That is, in this embodiment, the mechanical effect, or resistance detected by the detector 330 is a more straight forward open or closed reading of the valve 400, as opposed to a more gradually changing spin rate (of the device 320 of FIG. 3A).

Again, the detection may be readably normalized, irrespective of the physical nature of the fluid flow 300 (e.g. gas versus liquid, or some varying mixture). In the embodiment shown in FIG. 4B, the flow 300 of FIG. 4A is revealed to be of a pattern to alter the open and closed positioning of the valve 400. So, for example, a pattern of pulses having the appropriate rate, duration, and other signature characteristics may again be employed to signal firing of the perforation gun 165 of FIG. 1. In this manner, such a signature pattern may be detected by the detector 330, relayed via signal 301, and decoded at a processor of the electronics housing 160 so as to initiate perforating as depicted in FIG. 5.

As with the embodiment depicted in FIG. 3B, a particular signature pattern is revealed in the embodiment of FIG. 4B. For example, a series of valve opening pulses exceeding about one minute in duration with a closed period of about two minutes in between are employed to initiate firing in a perforating application. Again however, a variety of different signature patterns may be employed utilizing a host of different detectable flow rates, pulse durations, delays and other characteristics.

Referring now to FIG. 5, an enlarged view of a firing actuation triggered by an embodiment of the flow activated sensor assembly 100 of FIGS. 1 and 2. More specifically, FIG. 5 depicts the above described perforating gun 165 within the well 280 upon firing a charge 550 into the formation 290. Thus, a perforation 293 is formed. The perforation 293 may exceed about 1 foot into the formation 290 so as to aid in hydrocarbon recovery therefrom. In the embodiment shown, the charge 550 may be fired from one of a variety of caps 500 at the end of the charge extension 569. As shown, a single perforation 293 is formed. However, anywhere from about 2 to about 10 shots per foot may be fired by caps 500 of a conventional gun extension 169.

With added reference to FIGS. 1, 3A and 3B, the caps 500 themselves may be directed for firing by the firing head 167 upon signaling from the noted electronics housing 160. This signaling may in turn be based on information relayed from the detector 330 of the assembly 100 as detailed hereinabove. Of course, as noted above, these detections may now take place based on flow 300 without reliability concerns where the flow 300 is to take the form of a gas, as may be the case where other perforations or production are already present in the well 280.

Figure 6:
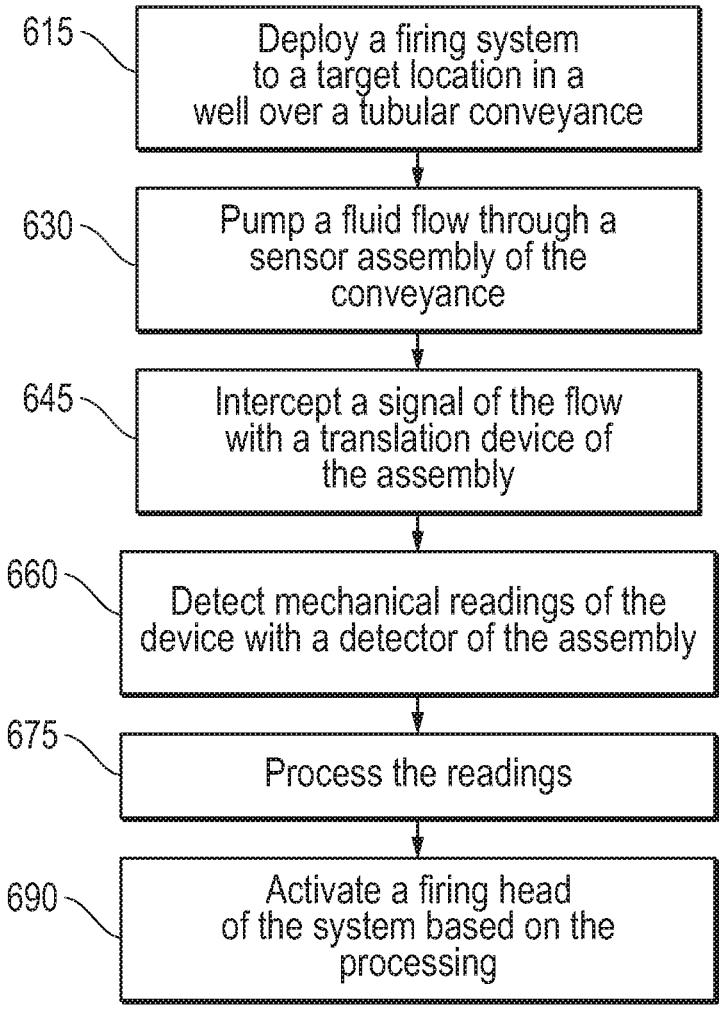
FIG. 6 is a flow-chart summarizing an embodiment of employing a flow activated sensor assembly for triggering of a downhole firing head.

Referring now to FIG. 6, a flow-chart summarizing an embodiment of employing a flow activated sensor assembly is depicted for triggering of a downhole firing head. The assembly is incorporated into a system that accommodates the firing head and is reliably responsive to a fluid flow therethrough, irrespective of the particular physical nature of the flow.

With more direct reference to FIG. 6, the noted system, with firing head and sensor assembly, may be deployed within a well to a target location as indicated at 615. A fluid flow may be pumped through a tubular conveyance which deploys the system and assembly (see 630). Of particular note, a translation device of the assembly may intercept flow as indicated at 645, which may itself be of a particular signature or pattern as directed from an oilfield surface.

The above-noted mechanical interception of flow signature may serve as a manner of translation which allow for enhanced detection to take place at a conventional detector of the assembly as indicated at 660. Thus, flow may take forms such as nitrogen gas which may otherwise be of compromised reliability where more direct detection is employed without such a mechanical translation.

Once enhanced detection of improved reliability is obtained via the detector, readings may be conventionally processed as indicated at 675. Thus, a firing head may be activated as noted at 690, for example to initiate a perforating application. Of course, the same types of flow sensing activation techniques may be employed to set a packer such as through a hydrostatic set module or to direct a variety of other downhole actuations.

Embodiments described hereinabove include sensor assemblies that allow for timely and accurate flow directed activation of downhole tools. Indeed, the assemblies may allow for timely and accurate responsiveness irrespective of whether or not the fluid-flow is liquid based or subject to any imbalance of fluid hydrostatics. So, for example, in applications where the introduction of liquids would be a drawback to operations, fluid-flow activation may nevertheless reliably proceed via gas flow signaling.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, as detailed herein, the translation device of the assembly may take the form of a flapper valve, check valve, or propeller configuration so as to provide decipherable mechanical detections. However, detections of a mechanical nature from a translation device in the form of a reciprocating piston or other suitable mechanism may also be employed. Furthermore, the foregoing description should not be read as pertaining only to the precise structures described and shown in the accompanying drawings, but rather should be read as consistent with and as support for the following claims, which are to have their fullest and fairest scope.

I claim:

1. A flow activated sensor assembly for downhole use in a well, the assembly for coupling to an oilfield tubular for conveying a fluid flow through a channel thereof, the assembly comprising:

a flow translation device for fluid communication with the channel to allow responsive movement upon exposure to the fluid flow;

a detector coupled to said device for data communication therewith, said detector configured for triggering activation of an actuator coupled to the assembly based on the data communication; and a backup detection mechanism for triggering upon compromised reliability of the data communication, wherein the backup detection mechanism detects flow of another fluid directed in an annular region.

2. The assembly of claim 1 wherein said flow translation device is selected from a group consisting of a spinner device, a check valve, a flapper valve and a reciprocatable piston.

3. The assembly of claim 2 wherein the spinner device is filter protected relative the fluid flow through the channel.

4. The assembly of claim 2 wherein the spinner device is disposed at a constricted location of the assembly relative an inner diameter of the channel.

5. The assembly of claim 1 wherein the backup detection mechanism comprises a transducer for having fluid exposure to the well.

6. A system for triggering an application in a well at a target location, the system comprising:

an oilfield tubular for conveying a fluid flow through a channel thereof;

a sensor assembly having a flow translation device incorporated therein for mechanical responsiveness to the fluid flow;

an electronics housing for processing data acquired from a detector coupled to said translation device;

an actuator for the triggering, said actuator coupled to said housing for obtaining the processed data therefrom;

a redundant sensor assembly having a second flow translation device incorporated therein coupled to the electronics housing, the redundant sensor assembly sensing fluid directed in an annulus; and a tool for carrying out the application at the target location.

7. The system of claim 6 wherein said actuator is selected from a group consisting of a firing head and a hydrostatic set module.

8. The system of claim 6 wherein said tool is one of a perforation gun, a plug and a packer.

9. The system of claim 6 wherein said tubular is selected from a group consisting of coiled tubing, drill pipe and a production tubular.

10. The system of claim 6 wherein the fluid flow is of an inert gas.

11. The system of claim 10 wherein the well is a producing well.

12. A method of activating a downhole tool for an application in a well at a target location, the method comprising:

pumping a fluid flow through a tubular conveyance into the well;

intercepting a signal of the fluid flow with a translation device of a sensor assembly coupled to the conveyance;

detecting mechanical output from the translation device resulting from said intercepting;

employing a backup detection mechanism of the assembly for the activating, wherein said employing comprises:

directing another fluid flow through an annulus of the well adjacent the assembly therein; and obtaining a signal of the fluid flow with a transducer of the assembly in fluid communication with the annulus; and processing detections from said detecting to trigger the activating.

13. The method of claim 12 further comprising performing the application with the tool.

14. The method of claim 13 wherein said performing comprises perforating a formation defining the well at the target location.

15. The method of claim 12 wherein the signal of the fluid flow is of a pattern of pulses.

16. The method of claim 15 wherein said detecting comprises acquiring mechanical responsiveness from the translation device corresponding to the pattern of pulses.

17. The method of claim 16 wherein the pattern of pulses comprise pulses of a predetermined magnitude and duration with a predetermined delay therebetween.

* * * * *